US006504904B2

(12) United States Patent
Danielsson

(10) Patent No.: US 6,504,904 B2
(45) Date of Patent: Jan. 7, 2003

(54) SIMPLIFIED ALIGNMENT AND INCREASED EFFICIENCY OF X-RAY IMAGING APPARATUS SETUP

(75) Inventor: Mats Danielsson, Taby (SE)

(73) Assignee: Mamea Imaging AB, Taby (SE)

( * ) Notice: Subject to any disclaimer, the term of this patent is extended or adjusted under 35 U.S.C. 154(b) by 0 days.

(21) Appl. No.: 09/682,646

(22) Filed: Oct. 1, 2001

(65) Prior Publication Data

US 2002/0057761 A1 May 16, 2002

Related U.S. Application Data

(63) Continuation of application No. PCT/SE00/00642, filed on Apr. 3, 2000.
(60) Provisional application No. 60/154,092, filed on Sep. 15, 1999.

(51) Int. Cl.[7] ..... G21K 5/10
(52) U.S. Cl. ..... 378/149; 348/147; 348/205
(58) Field of Search ..... 378/146, 147, 378/148, 149, 150, 205

(56) References Cited

U.S. PATENT DOCUMENTS 4,096,391 A * 6/1978 Barnes ..... 378/146
4,649,559 A 3/1987 Wang
4,891,833 A * 1/1990 Bernardi ..... 378/145
4,953,189 A * 8/1990 Wang ..... 378/146
5,054,048 A * 10/1991 Wang ..... 378/146

FOREIGN PATENT DOCUMENTS

DE 2753119 A1 6/1978
WO WO8201124 A1 4/1982

* cited by examiner

*Primary Examiner*—Drew A. Dunn
(74) *Attorney, Agent, or Firm*—Howrey Simon Arnold & White LLP

(57) ABSTRACT

The invention relates to a scanned-slot x-ray imaging system, having a first collimator and a second collimator arranged in a first distance (a) and a second distance (b), respectively, from a radiation source and each provided with a slot and a detector located under the second collimator slot, said slot of said second collimator being wider than the said slot of said first collimator and said detector under the second slot is wider than the first collimator slot and the second collimator slot. The slot of said second collimator has a width (y') not less than a safety margin and the product of the width (x) of the slot of said first collimator and said second distance (b) divided with the said first distance (a) for allowing a misalignment with respect to a central symmetry line of said slots.

12 Claims, 3 Drawing Sheets

SIMPLIFIED ALIGNMENT AND INCREASED EFFICIENCY OF X-RAY IMAGING APPARATUS SETUP

CROSS REFERENCE TO RELATED APPLICATIONS

The present application is a continuation of International Application No. PCT/SE00/00642, filed Apr. 3, 2000, which claims priority to Swedish Application No. 9901230-4, filed Apr. 1, 1999 and U.S. Provisional Application No. 60/154,092, filed Sep. 15, 1999.

BACKGROUND OF INVENTION

1. Technical Field

The present invention relates to a scanned-slot X-ray imaging system having a first collimator and a second collimator arranged at a first distance and a second distance, respectively, from a radiation source. Each collimator is provided with a slot and a detector located under the second collimator slot, with the slot of the second collimator being wider than the slot of the first collimator, and the detector under the second slot being wider than the first collimator slot and the second collimator slot.

2. Background Information

Typical X-ray imaging systems consist of an X-ray source in front of an object and an area detector behind the object for registering the image. However, this set-up is sensitive to background noise in the form of Compton scattered radiation. Existing methods to remove this background noise are inefficient, and also tend to remove part of the primary X-rays containing the image information. This result in requiring dose increases exceeding a factor of two (2) or more.

One solution to this problem is a scanned-slot set up. With this solution, a pre-collimator slot before the object shapes the X-ray beam so that it matches the active detector area. The slot is mechanically moved in order to image the entire object. It is also possible to move or have the object move with respect to the slot. However, this can be more inconvenient as the object is usually heavier than the mechanics for the slot. Still, the solution is advantageous since only a narrow fan-beam crosses the object at any single time and the area of the secondary collimator is small relative to the area of the captured image, thereby minimizing the amount of Compton scattered X-rays. Another advantage with the scanned-slot approach is that the required detector area is much smaller. This reduces costs, and also enables the use of more expensive and efficient detector materials if desired.

A drawback with the scanned-slot geometry is that only a small fraction of the X-rays from the source is actually used to form the image. As a result, the time for image acquisition is extended, requiring the X-ray tube to be turned on for a longer period of time. A way of mitigating this problem and achieving a practical system is to use a multi-slot collimator with different detector arrays under each slot. However, this makes image acquisition difficult since information from the different detectors has to be combined together into one image without any visible artifacts, such as border lines between areas where different detectors are used.

One of the most important constraints of medical X-ray imaging systems is avoiding patient exposure to X-rays in areas where there is no active detector for registering the X-rays. Such exposure only leads to an unnecessary dose increase. In a multi-slot setup, alignment is crucial since the detectors need to cover the full area under each slot.

International Patent Application No. WO 82/01124 describes an apparatus having a planar, proximity type X-ray image intensifier for detecting a fan beam of X-rays and for producing an intensified output visible light image on an output display screen. This fan beam is sensed by a scannable, linear array of solid state diode detectors. In one embodiment, a pair of side-by-side arrays are utilized in eliminating flare effects in the display screen. One of the linear arrays looks at the line signal on the output screen, while the second linear array looks at a location on the output screen adjacent and parallel to the line signal. A net signal is derived by subtracting the signals from adjacent elements of the two parallel arrays so that signal flare in the image intensifier tube is removed. In another embodiment, display screen flare is eliminated by covering the vacuum side of the display screen with metal having a thickness sufficient to dissipate one third of the kinetic energy of photo-electrons passing through it.

U.S. Pat. No. 4,649,559 discloses a large area, digital radiography apparatus. In this patent, a pre-scatter and a post-scatter collimator are moved simultaneously with an X-ray image intensifier tube, whose output display is scanned by a stationary scanning camera producing a digitized X-ray image over a large cross-sectional area of the patient.

It is important that the detectors cover the whole X-ray-imaging object in the direction orthogonal to the scan and without any gaps between detectors. For semiconductor detectors, this is an engineering challenge since there is always a dead area close to the edge of the detector. This is caused by mechanical damage when cutting the detectors on the wafer. Usually, a guard-ring is placed between the edge and the active detector area in order to sink leak current emanating from the mechanical damages. Ideally, none of this dead area is exposed to the diagnostic X-rays.

SUMMARY OF INVENTION

One object of the present invention is to provide a setup for multi-slot medical X-ray imaging that greatly simplifies the alignment, while also presenting a method for tiling different semiconductor detectors to cover the whole slot without introducing any dead area in between detectors.

Another object of the present invention is to allow for a misalignment with respect to the central symmetry line with less than a safety factor so that no primary radiation is lost in the post collimator.

These objects are accomplished by arranging the previously mentioned slot of the second collimator with a width not less than a pre-determined safety margin. The product of the slot width of the first collimator and the second distance is divided by the first distance for allowing a misalignment with respect to a central symmetry line of the slots.

Furthermore, the system can comprise a plurality of first and second collimators and detectors arranged side-by-side, thereby enabling a multi-slot scan.

In a preferred embodiment, the detector is a semiconductor detector and can be oriented so that an edge faces the incident X-rays. However, the detector can also be a film-screen combination, a CCD coupled to a scintillator through optical fiber bundles, or a gas detector.

If the detector is a gas detector, it can have a drift field for electrons released through interactions with the X-rays to drift to the edge of the detector where the signal is amplified and registered.

The invention also includes, in a scanned-slot X-ray imaging system, a first collimator and a second collimator arranged in a first distance and a second distance, respectively, from a radiation source. Each collimator is provided with a slot and a detector located under the second collimator slot, with the second collimator slot being wider than the first collimator slot, and the detector under the second slot being wider than the first collimator slot and the second collimator slot. The invention further provides for a method for allowing a misalignment with respect to a central symmetry line of the slots. The method comprises arranging the second collimator slot so that its width is not less than a safety margin. The product of the first collimator slot width and the second distance is divided by the first distance. Moreover, the collimators can be arranged so that a dead area on the detector is not exposed to the X-ray.

BRIEF DESCRIPTION OF DRAWINGS

In the following, the invention will be described with reference to non-limiting drawings, illustrating a preferred embodiment, in which.

DETAILED DESCRIPTION

Figure 1:
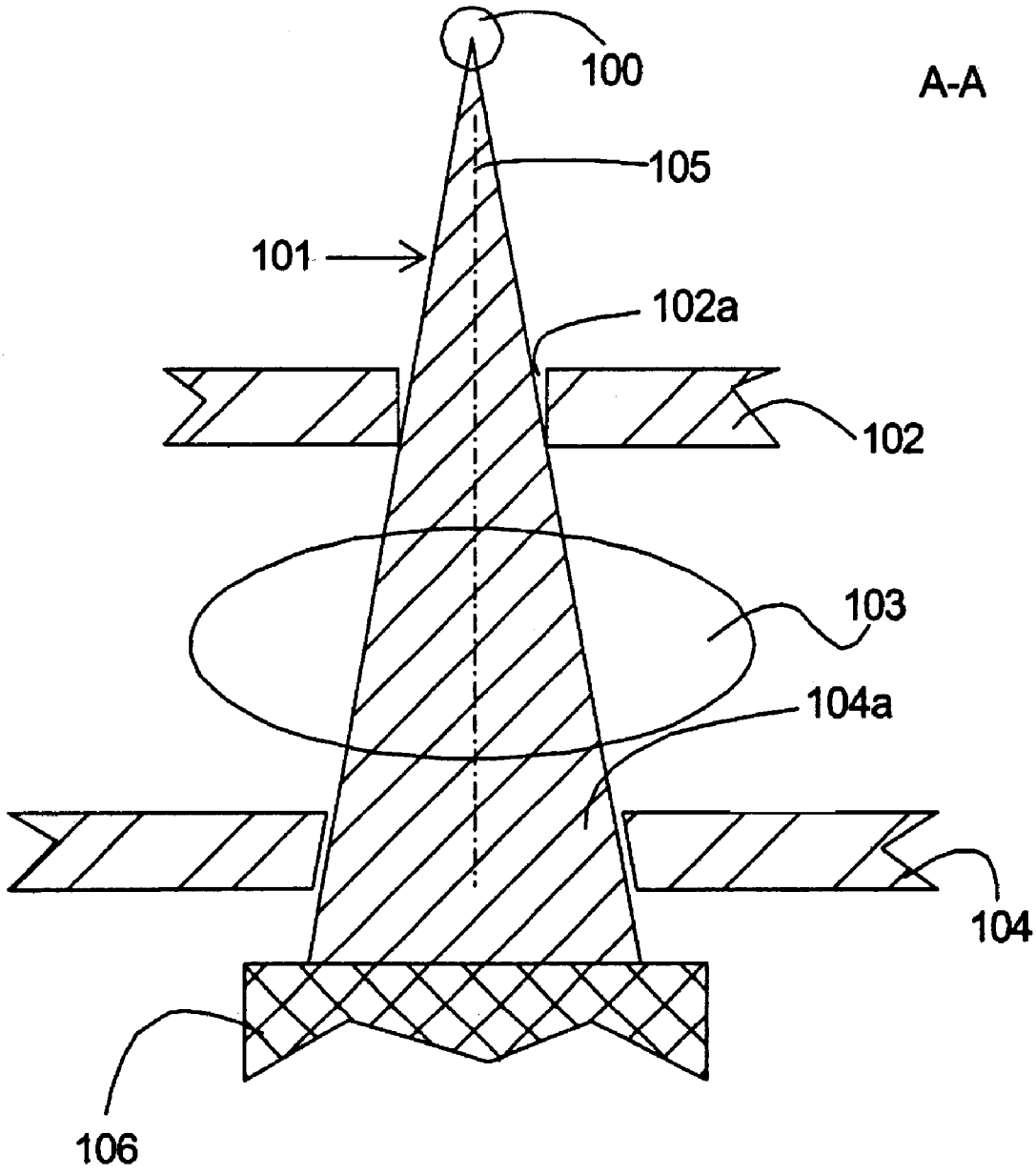
FIG. 1 is a schematic cross-sectional view of an embodiment according to the invention.

A preferred embodiment of a scanned-slot X-ray imaging setup is displayed in FIG. 1. It comprises a first collimator 102 provided with a first slot 102*a*, and a second collimator 104 provided with a second slot 104*a*. The collimators are spaced apart so that a space is provided in which an object 103 to be examined is positioned. A detector 106 is located beneath the second collimator 104. An X-ray source 100 is also provided.

X-rays 101 incident to the setup are shaped by the first collimator 102 so that they hit the detector 106. The second collimator 104 absorbs Compton scattered X-rays from the object 103. Ideally, the collimators 102,104 and the detector 106 are symmetrical with respect to a centerline 105. If the slots are equal in width, and the detector also has this width, any misalignment caused by deviation from the symmetry line 105 for one of the slots or the detector results in a loss in efficiency. To avoid this problem, the second collimator slot 104*a* is slightly wider in comparison to the first collimator slot 102*a*. Moreover, the detector 106 width is not only larger than the collimator slot 102*a*, but also larger than the collimator 104. This arrangement is indicated in slightly exaggerated form in FIG. 1. With this setup, the system is insensitive to small misalignments with respect to the symmetry line 105, decreasing manufacturing cost while improving reliability.

Figure 2:
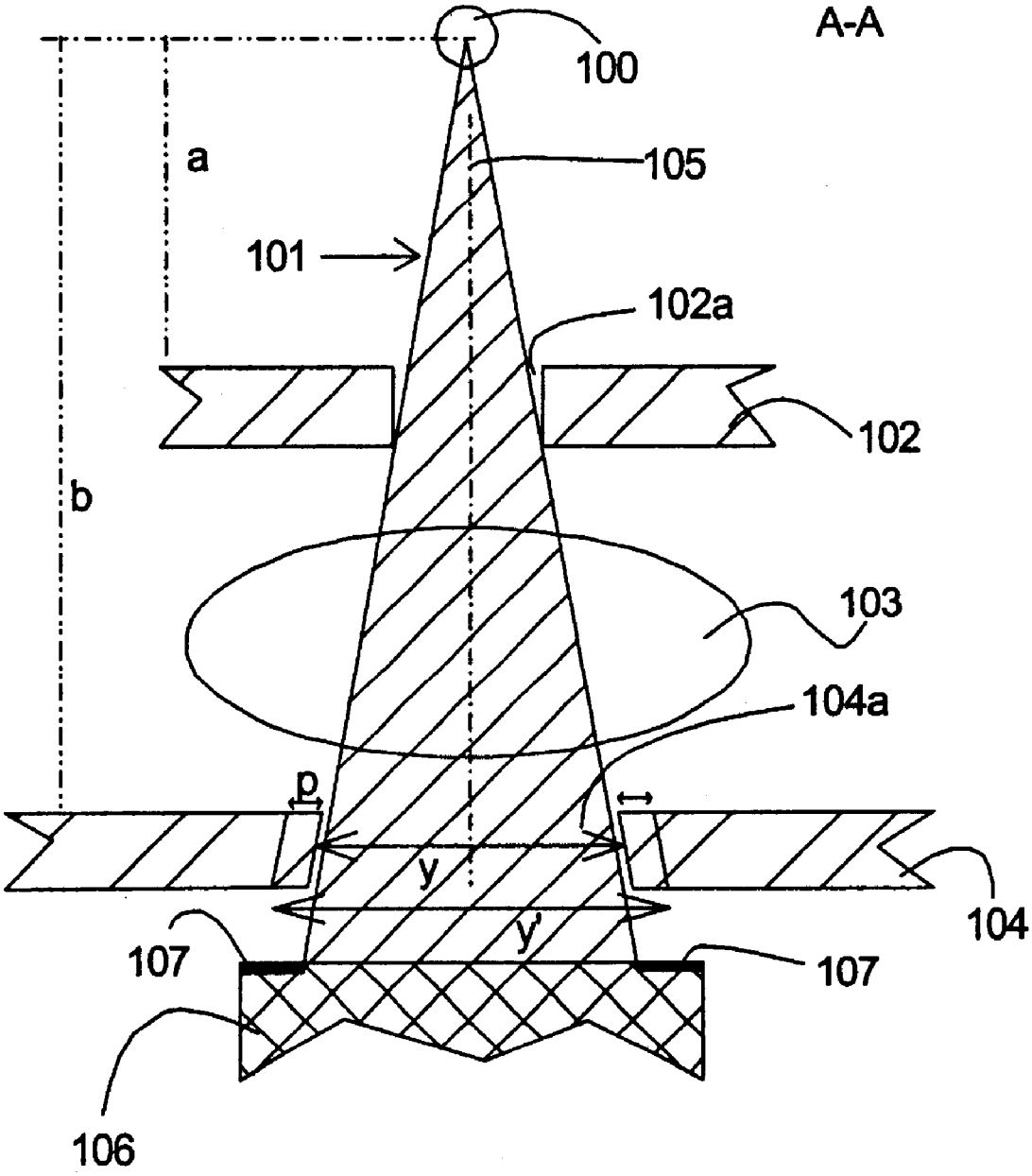
FIG. 2 is a schematic cross-sectional view of the embodiment according to FIG. 1 provided with distance signs.

FIG. 2 illustrates the principle of the invention. It is assumed that the distance between the source 100, first collimator 102 and the second collimator 104 is a and b, respectively, the width of the slot of first collimator 102*x*, and the width of the slot of the second collimator 104*y*. Taking into the account the magnification due to the divergent X-ray beam and the principle of similar triangles, then $$\frac{a}{x} = \frac{b}{y} \text{ or } \frac{x}{a} = \frac{y}{b} \Rightarrow y = \frac{xb}{a}$$

What is needed is a wider second collimator such that y+2p=y'>y, i.e., xb/a+2p>y, where p is a safety margin and y' is the desired width. Therefore, a misalignment can be allowed with respect to the central symmetry line less than the safety margin p and still not loose any primary radiation in the second collimator 2. The same reasoning is applicable to the detector width.

The safety factor p depends on the stability of the actual beam, and corresponds to a probability of misalignment. The range of p may be between about 0 to about 200 $\mu$m. The distance p should be chosen such that any increase in radiation dose due to misalignment should be less than about 5% of the total radiation dose given to the patient. The probability for misalignment has to be assessed through repetitive measurements under realistic operating conditions for the X-ray imaging set-up. The loss factor for primary radiation may be about 1%.

Moreover, the dead area 107 is due to mechanical damage when cutting the detectors on the wafer. This dead area 107 is usually provided with a guard-ring placed between the edge and the active detector area to sink leak current emanating from the mechanical damage. The dead area is so covered by the collimator 104 that it is not exposed to the X-rays.

The collimators 102,104 are preferably made from efficient absorbers, such as W, Cu or Fe. The detector could be a silicon strip detector, a charge coupled device ("CCD") camera coupled to a scintillating screen or a gas avalanche detector such as a parallel plate chamber. In the case of the CCD camera coupled to the scintillating screen, this coupling could be provided through, for example, optical fiber bundles.

In case of silicon strip detectors, the wafers can be made at least about 500 $\mu$m thick without problems. The signals are registered by standard state of the art electronics. When the detector is a semiconductor detector, it can be advantageously oriented edge-on to the incident x-rays. By edge-on, it is meant that the X-rays incite one edge of the of the detector, which also can be tilted slightly. Another option would be to provide a detector in the form of a film screen combination.

A gas detector with the gas volume oriented edge-on can be made to any desired thickness by introducing a drift volume where the electrons created through interaction with the gas molecules can be collected through an electric drift field and drifted towards the edge of the detector where avalanche multiplication can take place and the signal registered by state of the art electronics.

Figure 3:
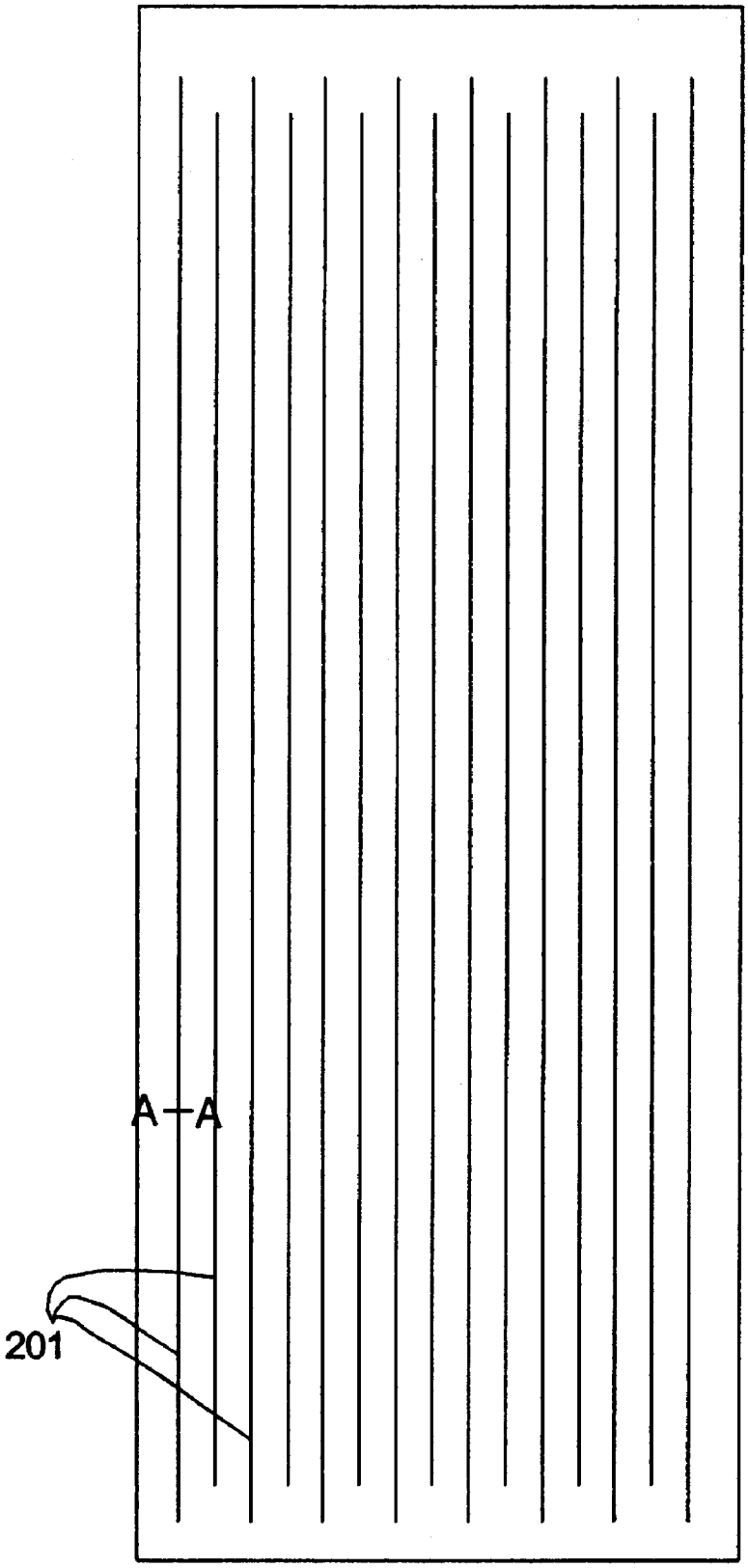
FIG. 3 is a schematic top view of a system with a plurality of first collimator slots.

In FIG. 3, a top view of a system with a plurality of first collimator slots is displayed. Each of the lines 201 indicates one slot, i.e., a hole cut in the metal with a width equivalent to the desired width of the X-ray beam after passing the collimator. As shown, there is a plurality of collimators in two dimensions. FIGS. 1 and 2 correspond to a cross-section along line A—A in FIG. 3 for any of the slots 201 indicated in FIG. 3.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A scanned-slot x-ray imaging system comprising:

a first collimator and a second collimator, wherein each collimator further comprises a carrier arranged with plurality of substantially parallel slots, each arranged in a first distance and a second distance, respectively, from a radiation source and each provided with slots and a detector located after the second collimator slots, said slots of said second collimator being wider than the said slots of said first collimator and said detector under the second slots is wider than the first collimator slots and the second collimator slots, wherein said slots of said second collimator has a width not less than a safety margin and the product of the width of corresponding slots of said first collimator and said second distance divided by said first distance, said width being arranged to allow a misalignment with respect to a central symmetry line of said slots and prevents introduction of a dead area on the detector.

2. The system as claimed in claim 1, further comprising a plurality of first and second collimators and detectors arranged side-by-side to enable a multi-slot scan.

3. The system as claimed in claim 1, wherein said detector is a semiconductor detector.

4. The system as claimed in claim 3, wherein said detector is a semiconductor detector oriented such that an edge of it faces said incident X-rays.

5. The system as claimed in claim 1, wherein said detector is a film-screen combination.

6. The system as claimed in claim 1, wherein said semiconductor detector is a CCD coupled to a scintillator through optical fiber bundles.

7. The system as claimed in claim 1, wherein said detector is a gas detector.

8. The system as claimed in claim 7, wherein said detector has a drift field to drift the electrons released through interactions with the X-rays to the edge of the detector where the signal is amplified and registered.

9. The system as claimed in claim 1, wherein said safety margin is chosen so that any increase in radiation dose due to misalignment is less than about five percent (5%) of the total radiation dose.

10. A method for allowing for misalignment in a scanned-slot X-ray imaging system, the method comprising the steps of:

providing a first collimator arranged at a first distance from a radiation source and a second collimator arranged at a second distance from said radiation source;

providing said first and second collimator with more than one substantially parallel slots, wherein said slots of said second collimator are wider than said slots of said first collimator;

providing a detector under said second collimator slots, wherein said detector is wider that the first collimator slots and the second collimator slots; and arranging said slots of said second collimator such that their width is not less than a safety margin and the product of the width of the slots of said first collimator and said second distance divided with said first distance, thereby preventing introduction of a dead area on said detector.

11. The method of claim 10 further comprising the step of arranging said collimators so that a dead area on said detector is not exposed to said X-ray.

12. The method of claim 10 further comprising the step of choosing said safety margin so that any increase in radiation dose due to misalignment is less than about five percent (5%) of the total radiation dose.

* * * * *